US011799236B2

(12) United States Patent
Matsumoto et al.

(10) Patent No.: US 11,799,236 B2
(45) Date of Patent: Oct. 24, 2023

(54) CABLE CONNECTOR HAVING A FITTING PROTRUSION FOR INSERTION INTO A MATING CONNECTOR

(71) Applicant: J.S.T. Mfg. Co., Ltd., Tokyo (JP)

(72) Inventors: Hiroyuki Matsumoto, Yokohama (JP); Kenichi Nishimoto, Yokohama (JP)

(73) Assignee: J.S.T. MFG. CO., LTD., Tokyo (JP)

( * ) Notice: Subject to any disclaimer, the term of this patent is extended or adjusted under 35 U.S.C. 154(b) by 28 days.

(21) Appl. No.: 17/560,122

(22) Filed: Dec. 22, 2021

(65) Prior Publication Data

US 2022/0271471 A1 Aug. 25, 2022

(30) Foreign Application Priority Data

Feb. 25, 2021 (JP) ..... 2021-028171

(51) Int. Cl.
*H01R 13/52* (2006.01)
*H01R 13/506* (2006.01)

(52) U.S. Cl.
CPC ..... *H01R 13/5205* (2013.01); *H01R 13/506* (2013.01)

(58) Field of Classification Search
CPC ..... H01R 13/40; H01R 13/4361; H01R 13/4362; H01R 13/506; H01R 13/639; H01R 13/64; H01R 13/641; H01R 13/6456; H01R 13/6272
See application file for complete search history.

(56) References Cited

U.S. PATENT DOCUMENTS

| | | | | |
|---|---|---|---|---|
| 5,268,982 | A * | 12/1993 | Schaffer | G02B 6/3888 D13/133 |
| 5,289,554 | A * | 2/1994 | Cubukciyan | G02B 6/3831 385/83 |
| 6,491,542 | B1 * | 12/2002 | Zerebilov | H01R 13/639 439/352 |
| 7,090,543 | B2 * | 8/2006 | Lee | H01R 13/4362 439/752 |
| 7,682,205 | B2 * | 3/2010 | Hall | H01R 27/02 439/752 |
| 7,980,894 | B1 | 7/2011 | Hall | |
| 10,461,457 | B1 * | 10/2019 | Aono | H01R 13/4223 |
| 10,594,069 | B2 * | 3/2020 | Kon | H01R 13/436 |
| 2022/0263263 | A1 * | 8/2022 | Shiga | H01R 13/6272 |

FOREIGN PATENT DOCUMENTS

JP 2012-43798 A 3/2012

* cited by examiner

*Primary Examiner* — Oscar C Jimenez
(74) *Attorney, Agent, or Firm* — Kratz, Quintos & Hanson, LLP

(57) ABSTRACT

A cable connector includes: a housing including a cylindrical fitting protrusion to be inserted into a fitting opening of a mating connector; and a retainer that enables insertion of the fitting protrusion into the mating connector only when a cable accommodated in the housing is at a regular insertion position, in which the retainer includes a lock protrusion that is at a position where fitting with the mating connector is prevented when a cable accommodated in the housing is at an irregular insertion position, and is movable to a position where fitting with the mating connector is enabled when the cable is at the regular insertion position.

8 Claims, 10 Drawing Sheets

CABLE CONNECTOR HAVING A FITTING PROTRUSION FOR INSERTION INTO A MATING CONNECTOR

CROSS-REFERENCES TO RELATED APPLICATIONS

This application claims priority to Japanese Patent Application No. 2021-28171 filed on Feb. 25, 2021; and the entire contents of which are incorporated by reference herein.

TECHNICAL FIELD

The present invention relates to a cable connector including means for avoiding incorrect connection of cables.

BACKGROUND ART

JP 2012-043798 A below discloses an example of a coaxial cable connector. The coaxial cable connector includes a housing into which a coaxial cable is inserted, and a key portion and an engagement portion to be fitted to a mating connector are formed at a cylindrical fitting end of the housing. The key portion enables connection only to a mating connector having a corresponding key groove. The engagement portion is locked to the corresponding locking groove of the mating connector so that the coaxial cable connector is not unintentionally removed from the mating connector after being once engaged with the mating connector.

The coaxial cable connector of JP 2012-043798 A includes a lock member for preventing axial movement of a contact assembly connected to the coaxial cable inserted into the housing. However, the coaxial cable connector of JP 2012-043798 A does not include so-called terminal position assurance mechanism (TPA mechanism) that prevents the coaxial cable from being fitted to the mating connector when the coaxial cable is at an irregular insertion position.

FIGS. 10A to 10C illustrates an example of a conventional coaxial cable connector 90 including a mechanism that prevents a coaxial cable 930 inserted into a housing 910 from being fitted to a mating connector when the coaxial cable is at an irregular insertion position. The conventional coaxial cable connector 90 includes a housing 910 and a retainer 920. The housing 910 includes a housing body 911 and a cylindrical fitting protrusion 912. A cable accommodation opening 913 penetrating along the axial direction of the coaxial cable is formed inside the housing body 911 and the cylindrical fitting protrusion 912. In the housing body 911, a retainer accommodation opening 916 penetrating one side in the radial direction of the cable accommodation opening 913 is formed. A lock protrusion 915 protruding in the radial direction is provided from the housing body 911 to the outer surface of the cylindrical fitting protrusion 912.

The retainer 920 includes an upper plate portion 921, two leg portions 922 provided so as to hang downward from both sides in the width direction of the upper plate portion 921, and two interference protrusions 923 protruding from the upper plate portion 921 in the fitting direction, and a slot 924 through which the lock protrusion 915 of the housing 910 is inserted is provided between the two interference protrusions 923.

When the coaxial cable 930 is inserted into the cable accommodation opening 913 to a regular insertion position, the two leg portions 922 of the retainer 920 are inserted to the depth of the retainer accommodation opening 916, and the interference protrusion 923 is accommodated in the retainer accommodation opening 916 formed on the outer surface of the fitting protrusion 912.

When the assembly of the housing 910 and the retainer 920 is inserted into the mating connector in this state, the interference protrusion 923 is accommodated in the surface of the retainer accommodation opening 916 on the outer surface of the fitting protrusion 912, so that the assembly can be completely inserted into the fitting opening of the mating connector.

On the other hand, when the coaxial cable 930 is not completely inserted into the cable accommodation opening 913, that is, when the coaxial cable 930 is in the irregular insertion position, the two leg portions 922 of the retainer 920 interfere with the protrusions of the core housing mounted around the coaxial cable 930, and the assembly cannot be completely inserted into the retainer accommodation opening 916. At this time, the two interference protrusions 923 are at positions spaced apart from the outer surface of the fitting protrusion 912 by a certain distance radially outward. When the assembly of the housing 910 and the retainer 920 is inserted into the mating connector in this state, the interference protrusion 923 interferes with the housing around the fitting opening of the mating connector, and as a result, the housing 910 and the retainer 920 cannot be fitted to the mating connector.

SUMMARY

In the coaxial cable connector 90 described above, the interference protrusion accommodation opening 917 for accommodating the interference protrusion 923 of the retainer 920 within the surface of the outer surface of the fitting protrusion 912 when the coaxial cable 930 is at the regular insertion position is required. Therefore, the coaxial cable connector 90 cannot have waterproof performance.

Therefore, an object of the present invention is to provide waterproof performance in a cable connector having a configuration that can be fitted to a mating connector only when a cable is at a regular insertion position.

In order to solve the above problem, a cable connector according to the present invention includes:

a housing including a cylindrical fitting protrusion to be inserted into a fitting opening of a mating connector; and a retainer that enables insertion of the fitting protrusion of the housing into the mating connector only when a cable accommodated in the housing is at a regular insertion position, in which the retainer includes a lock protrusion that is at a position where fitting with the mating connector is prevented when a cable accommodated in the housing is at an irregular insertion position, and is movable to a position where fitting with the mating connector is enabled when the cable is at the regular insertion position.

According to an embodiment of the present invention, the fitting protrusion includes a first lock protrusion protruding in a radial direction, and the lock protrusion of the retainer is at a position shifted radially outward from the first lock protrusion as a second lock protrusion when the cable accommodated in the housing is at the irregular insertion position, and is aligned with the first lock protrusion at the same height in the radial direction when the cable is at the regular insertion position.

According to an embodiment of the present invention, the second lock protrusion of the retainer includes an opening that receives the first lock protrusion when the second lock protrusion is aligned with the first lock protrusion at the same height in the radial direction.

An embodiment of the present invention is characterized in that an opening is not formed on an outer circumferential surface of the cylindrical fitting protrusion.

According to the present invention, it is possible to provide waterproof performance in a cable connector having a configuration that can be fitted to a mating connector only when a cable is at a regular insertion position.

According to an aspect of the present invention, since both the first lock protrusion and the second lock protrusion can be locked to the engagement structure of the mating connector, fitting to the mating connector can be reliably maintained.

According to an aspect of the present invention, since the first lock protrusion is received in the opening of the second lock protrusion, the second lock protrusion can be strengthened, and the second lock protrusion can be prevented from being damaged when the second lock protrusion abuts on the engagement structure of the mating connector.

According to an aspect of the present invention, it is easy to waterproof the inside of the cylindrical fitting protrusion from the outside.

DETAILED DESCRIPTION

A coaxial cable connector 10 of the present embodiment will be described with reference to the drawings. The embodiments described below describe an example of the coaxial cable connector of the present invention, and the present invention is not limited to the coaxial cable connector 10, and should be equally applied to other forms of coaxial cable connectors described in the claims.

Figures 1A, 1B:
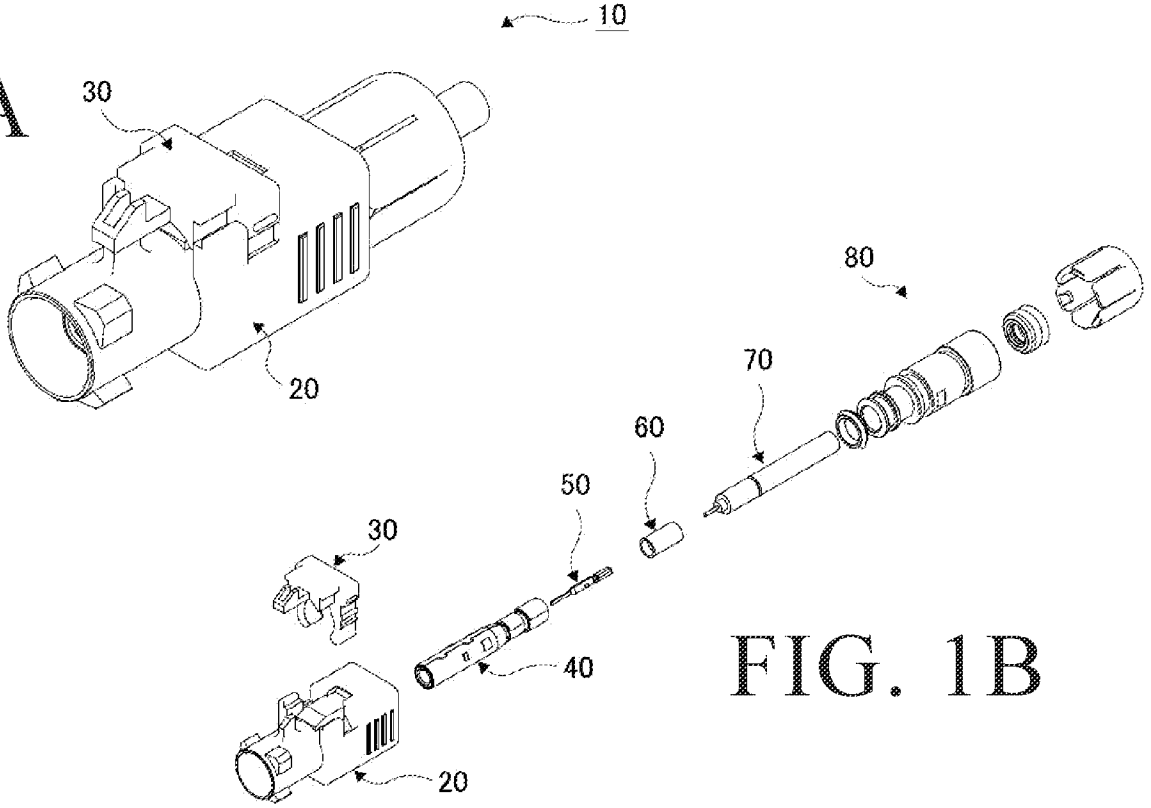
FIG. 1A is an external perspective view of a coaxial cable connector according to the present embodiment.
FIG. 1B is an exploded perspective view of the coaxial cable connector according to the present embodiment.
Figure 2:
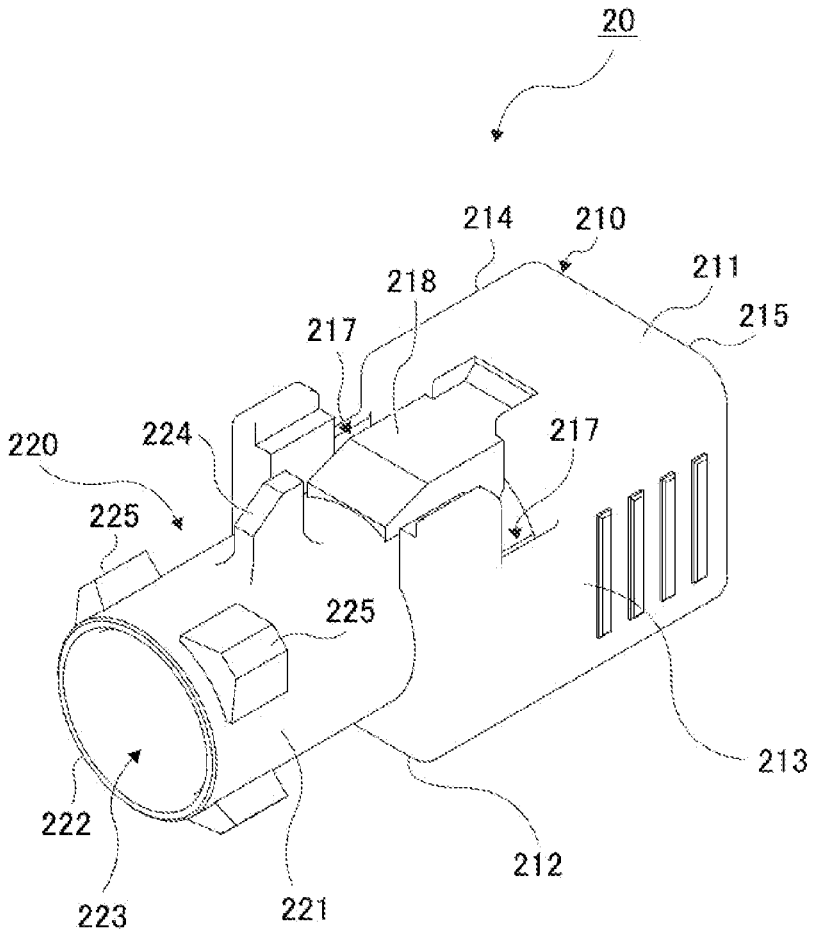
FIG. 2 is an external perspective view of a housing of the coaxial cable connector of the present embodiment.

An overall configuration of the coaxial cable connector 10 will be described with reference to FIGS. 1A and 1B. As illustrated in FIG. 1A, the coaxial cable connector 10 includes a housing 20 and a retainer 30. As illustrated in FIG. 1B, the coaxial cable connector 10 includes an outer contact 40, a center contact 50, a sleeve 60, a coaxial cable 70, and a core housing 80. The center contact 50 is connected to a center conductor of the coaxial cable 70. The sleeve 60 is connected to an outer conductor of the coaxial cable 70. The outer conductor of the coaxial cable 70 is folded back so as to cover an outer periphery of the sleeve 60, and the outer contact 40 is mounted to the periphery of the outer conductor. The core housing 80 is mounted to the periphery of the outer contact 40.

In the description below, a direction in which the coaxial cable 70 extends is referred to as a fitting direction, and in particular, a direction in which the coaxial cable connector 10 is fitted and connected to a mating connector (left side in the drawing of FIGS. 1A and 1B) is referred to as a front side in the fitting direction, and the opposite side is referred to as a rear side in the fitting direction. A direction orthogonal to the fitting direction (a vertical direction in FIGS. 1A and 1B) is referred to as a vertical direction, and a direction orthogonal to both the fitting direction and the vertical direction is referred to as a width direction.

The housing 20 will be described with reference to FIG. 2, and FIGS. 3A to 3D. The housing 20 includes a housing body 210 and a fitting protrusion 220. The housing body 210 has a substantially rectangular parallelepiped shape and includes an upper surface 211, a bottom surface 212, a right side surface 213, a left side surface 214, a rear surface 215, and a front surface (not denoted). A cable accommodation opening 216 is formed in the housing body 210 from the rear surface 215 toward the front side in the fitting direction.

On the upper surface 211 of the housing body 210, two retainer accommodation openings 217 are formed at positions close to the right side surface 213 and the left side surface 214, respectively, penetrate the upper surface 211 in the vertical direction, and are electrically connected to the cable accommodation opening 216. A retainer placement surface 218 is formed between the two retainer accommodation openings 217 along the fitting direction.

Figure 3A:
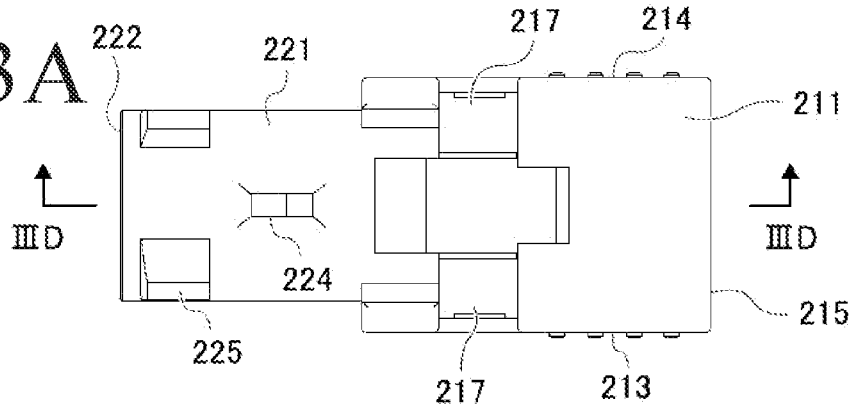
FIG. 3A is a top view of the housing of FIG. 2.
Figure 3B:
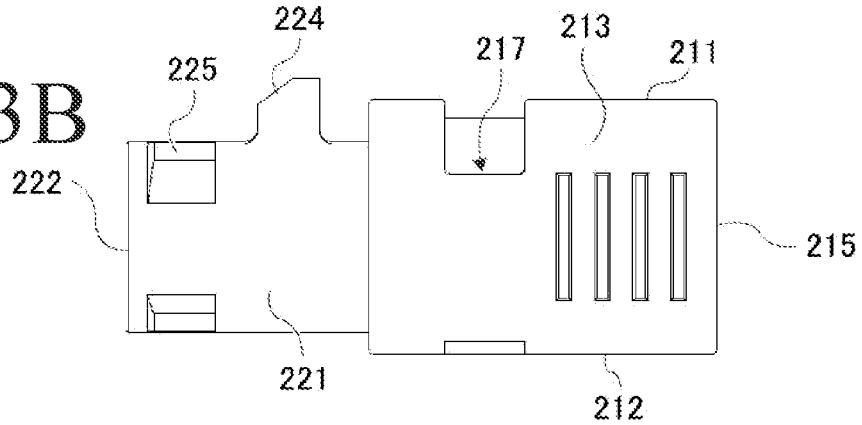
FIG. 3B is a side view of the housing of FIG. 2.
Figure 3C:
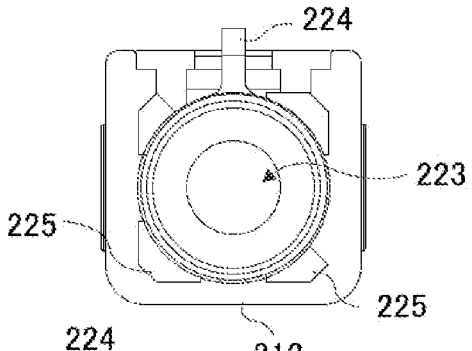
FIG. 3C is a front view of the housing of FIG. 2 as viewed from a fitting side.
Figure 3D:
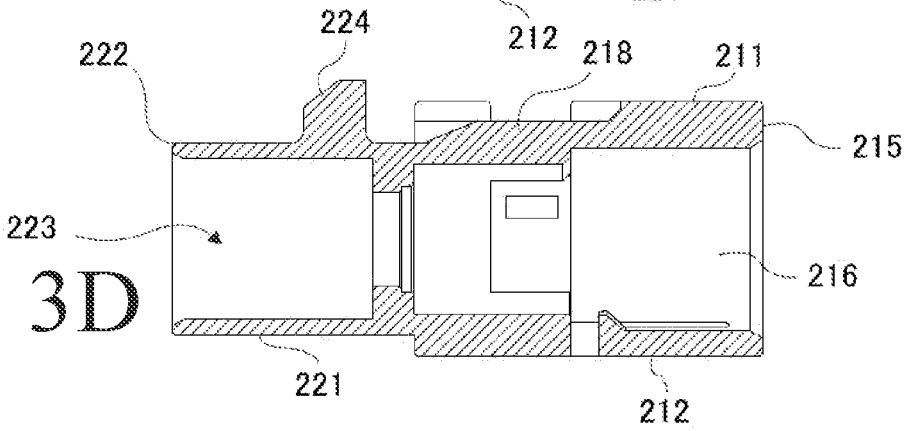
FIG. 3D is a cross-sectional view of the housing of FIG. 2 as viewed from a side taken along line IIID-IIID of FIG. 3A.
Figure 4:
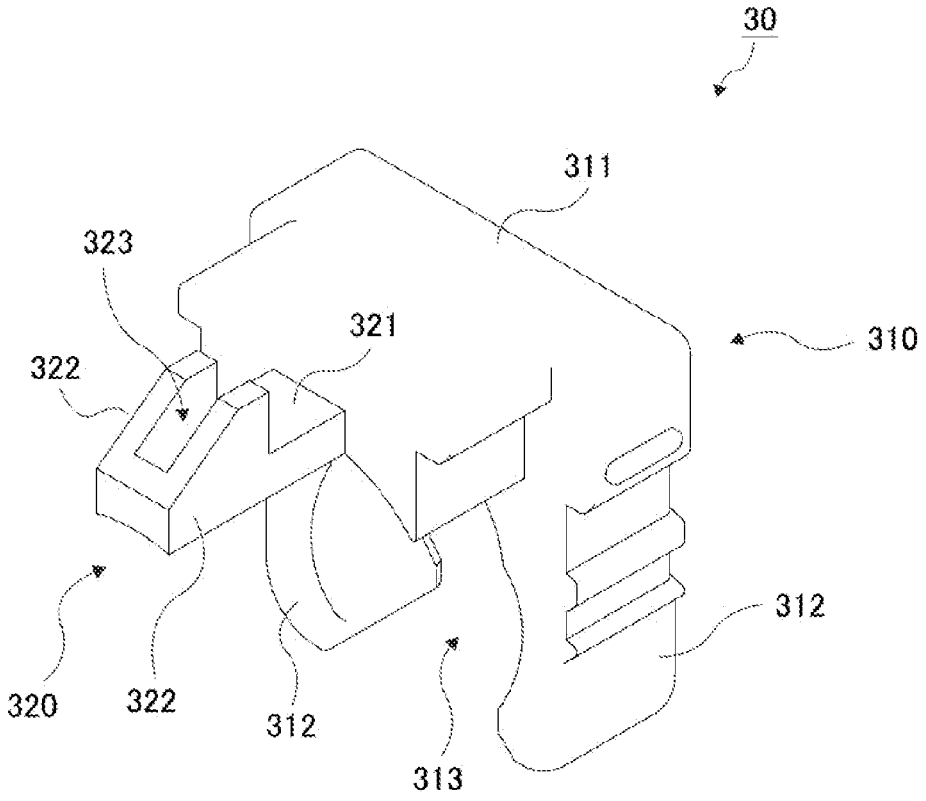
FIG. 4 is an external perspective view of a retainer of the coaxial cable connector of the present embodiment.
Figure 5A:
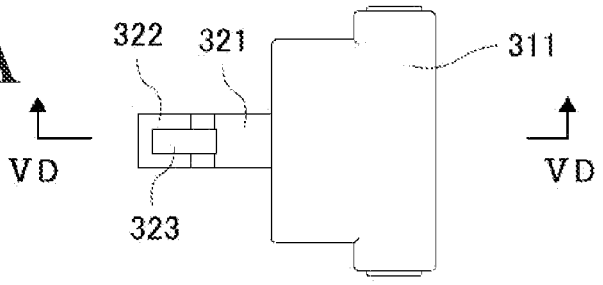
FIG. 5A is a top view of the retainer of FIG. 4.
Figure 5B:
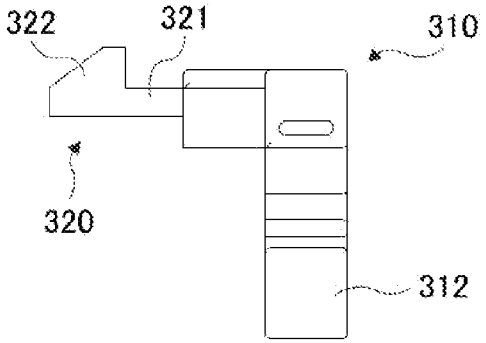
FIG. 5B is a side view of the retainer of FIG. 4.
Figure 5C:
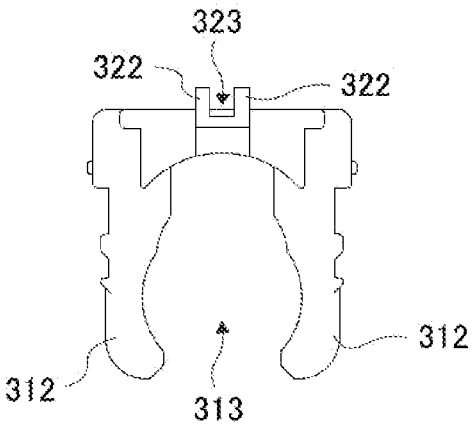
FIG. 5C is a front view of the retainer of FIG. 4.
Figure 5D:
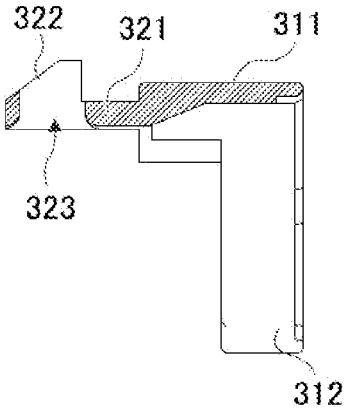
FIG. 5D is a cross-sectional view of the retainer of FIG. 4 as viewed from the side taken along line VD-VD of FIG. 5A.
Figure 10A:
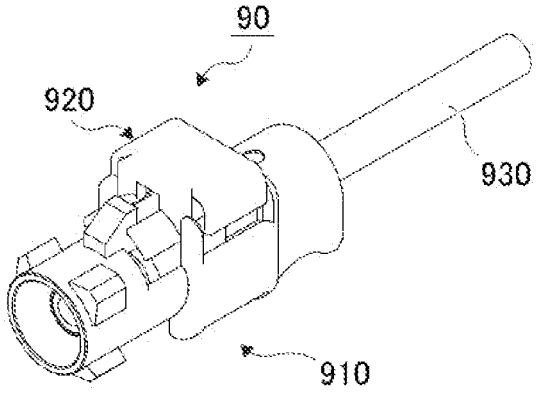
FIG. 10A PRIOR ART
FIG. 10A is an external perspective view of a coaxial cable connector of a conventional example.
Figure 10B:
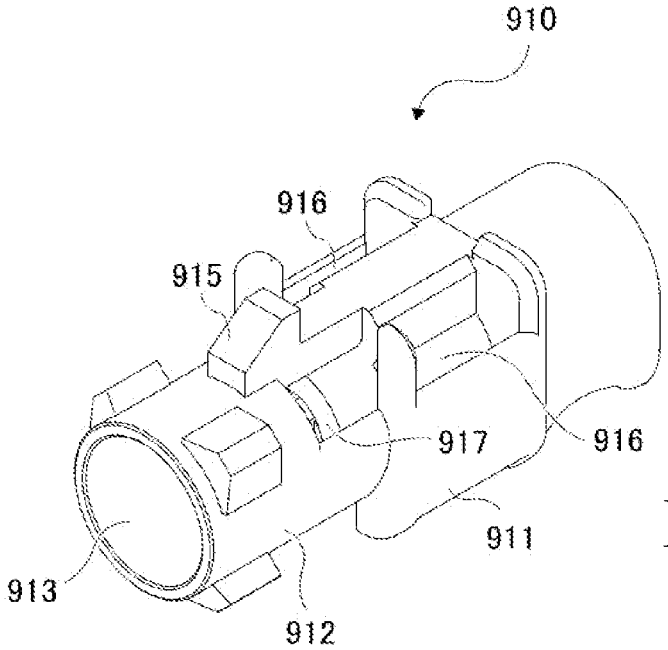
FIG. 10B PRIOR ART
FIG. 10B is an external perspective view of a housing of the coaxial cable connector of FIG. 10A.
Figure 10C:
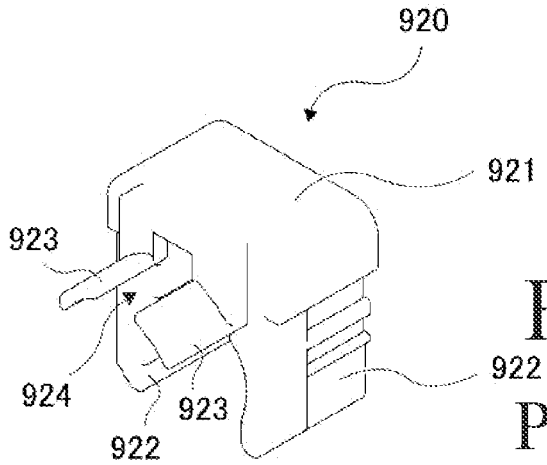
FIG. 10C PRIOR ART
FIG. 10C is an external perspective view of a retainer of the coaxial cable connector of FIG. 10A.

The fitting protrusion 220 is a cylindrical member extending in the fitting direction, and is inserted into a fitting opening of a mating connector 100 at the time of fitting with the mating connector 100. The fitting protrusion 220 includes a cylindrical portion 221 formed to protrude forward in the fitting direction from the front surface of the housing body 210. On an outer circumferential surface of the cylindrical portion 221, an opening as formed in the coaxial cable connector 90 of the conventional example in FIGS. 10A to 10C is not formed. A fitting opening 223 is formed toward the rear side in the fitting direction from a front end 222 of the cylindrical portion 221 toward the rear side in the fitting direction. As illustrated in FIG. 3D, the fitting opening 223 and the cable accommodation opening 216 formed in the housing body 210 are electrically connected inside.

A first lock protrusion 224 that protrudes radially, for example, upward is formed in an upper portion of the outer circumferential surface of the cylindrical portion 221 of the fitting protrusion 220. Although described later, the first lock protrusion 224 is for locking to an engagement member 104 of the corresponding mating connector 100. A plurality of key protrusions 225 are formed on the outer circumferential surface of the cylindrical portion 221. The key protrusion 225 is inserted into a key groove (not illustrated) formed in the corresponding mating connector 100, and the coaxial cable connector 10 can be fitted only to the mating connector having the corresponding key groove.

Next, the retainer 30 will be described with reference to FIG. 4, and FIGS. 5A to 5D. The retainer 30 according to the present embodiment holds the coaxial cable 70 in the housing body 210 when the coaxial cable 70 to which a contact configuration described later is mounted is at a regular insertion position in the cable accommodation opening 216 of the housing body 210. The retainer 30 also includes the following mechanism for allowing the fitting protrusion 220 of the housing 20 to be inserted into the mating connector 100 only when the coaxial cable 70 is in the regular insertion position.

The retainer 30 includes a retainer body 310 and an engagement portion 320. The retainer body 310 includes an upper plate portion 311 and two leg portions 312 formed so as to hang downward from both ends in the width direction of the upper plate portion 311. A cable accommodation space 313 is formed between the two leg portions 312. The engagement portion 320 includes a connecting portion 321 protruding forward from a front end of the upper plate portion 311 in the fitting direction, and a second lock protrusion 322 protruding upward on a front side of the connecting portion 321. A first lock protrusion accommodation opening 323 penetrating in the vertical direction is formed in the lock protrusion 322. Although described later, the first lock protrusion accommodation opening 323 is an opening that receives the first lock protrusion such that the coaxial cable 70 is at the regular insertion position and the first lock protrusion 224 and the second lock protrusion 322 are aligned with each other at the same height in the radial direction. Therefore, the length of the first lock protrusion accommodation opening 323 in the fitting direction is a length capable of receiving the first lock protrusion 224 of the housing 20, and the size of the first lock protrusion accommodation opening 323 in the width direction is the width of the first lock protrusion 224.

Figure 6A:
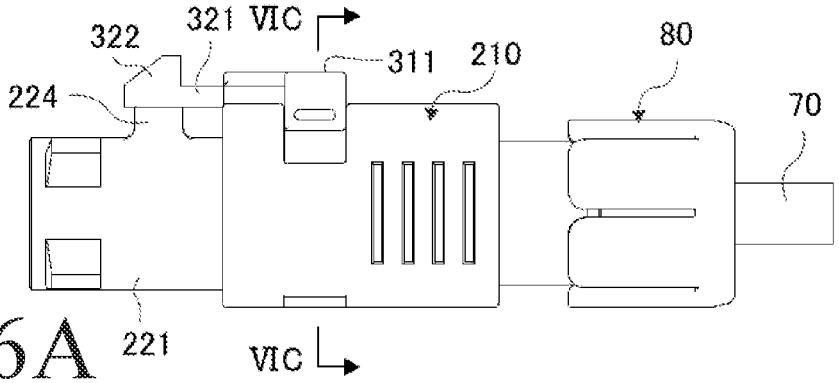
FIG. 6A is a side view when the coaxial cable connector is assembled and the coaxial cable is not at a regular insertion position.
Figure 6B:
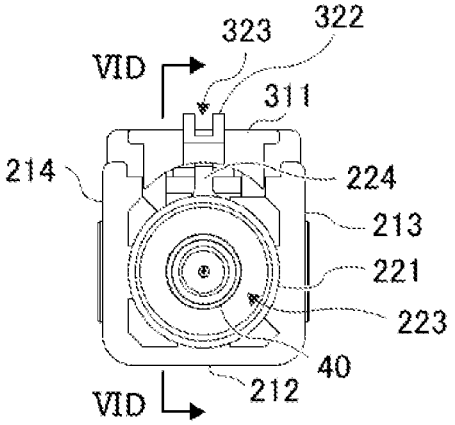
FIG. 6B is a front view when the coaxial cable connector in the state of FIG. 6A is viewed from the fitting side.
Figure 6C:
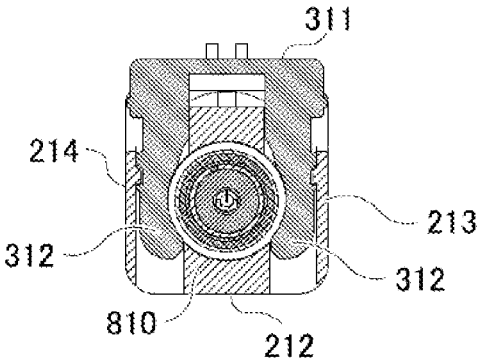
FIG. 6C is a cross-sectional view when the coaxial cable connector in the state of FIG. 6A is taken along line VIC-VIC and viewed from a side opposite to the fitting side.
Figure 6D:
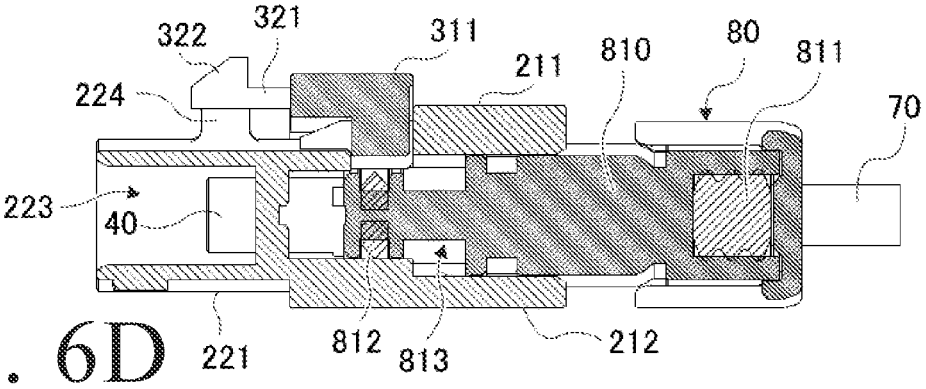
FIG. 6D is a cross-sectional view when the coaxial cable connector in the state of FIG. 6A is taken along line VID-VID in FIG. 6B and viewed from a side.

Assembly of the coaxial cable connector 10 and fitting with the mating connector 100 will be described with reference to FIGS. 6A to 9D. In a state where the center contact 50 and the outer contact 40 are connected to the coaxial cable 70 and the core housing 80 is mounted to a part of the periphery of the outer contact 40, the coaxial cable 70 and the contact mounted to the coaxial cable 70 are inserted into the cable accommodation opening 216 of the housing 20 from the rear side in the fitting direction. Then, as illustrated in FIG. 6D, the outer contact 40 is accommodated in the fitting opening 223 inside the fitting protrusion 220. A gap having a predetermined width is formed between the inner surface of the fitting opening 223 and the outer contact 40, and can receive a terminal of the mating connector 100.

As illustrated in FIG. 6D, the core housing 80 includes a core body 810. A wire seal 811 for maintaining watertightness between the coaxial cable 70 and the core body 810 and a connector seal 812 for maintaining watertightness of a fitting portion of the fitting opening 223 of the coaxial cable connector 10 are mounted to the core body 810. In the core body 810, an alignment slot 813 for aligning the coaxial cable 70 is formed to be annularly recessed along the outer circumferential surface of the core body 810.

In FIG. 6D, the insertion position of the coaxial cable 70 into the cable accommodation opening 216 is an irregular insertion position where the alignment slot 813 does not reach below the retainer accommodation opening 217 of the housing body 210. A case where the retainer 30 is mounted to the housing 20 in this state will be described. At this time, although the two leg portions 312 of the retainer 30 are inserted into the cable accommodation opening 216 from the retainer accommodation opening 217, as illustrated in FIG. 6(C, the downward movement of the leg portions 312 is prevented by the core body 810 of the core housing 80. Therefore, the retainer 30 cannot be completely inserted downward.

At this time, the upper plate portion 311 of the retainer body 310 of the retainer 30 is not flush with the upper surface 211 of the housing body 210 but protrudes upward from the upper surface 211. The second lock protrusion 322 of the retainer 30 is at a position separated from the outer circumferential surface of the fitting protrusion 220 by a predetermined distance outward in the radial direction, and is at a position to prevent fitting with the mating connector 100 as described later. The second lock protrusion 322 of the retainer 30 is at a position shifted radially outward from the first lock protrusion 224 of the housing 20, that is, at a position shifted upward from the first lock protrusion 224. At this time, the first lock protrusion accommodation opening 323 of the second lock protrusion 322 partially receives the first lock protrusion 224.

Figure 7A:
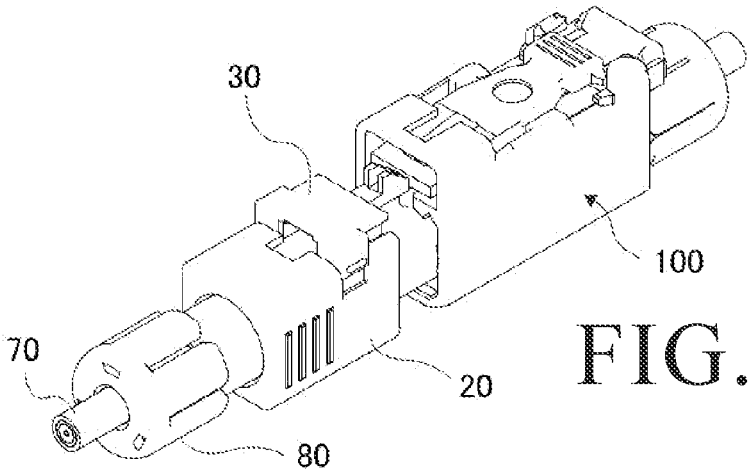
FIG. 7A is an external perspective view of a case where the coaxial cable connector is fitted to a mating connector in a state where the coaxial cable is not at the regular insertion position.
Figure 7B:
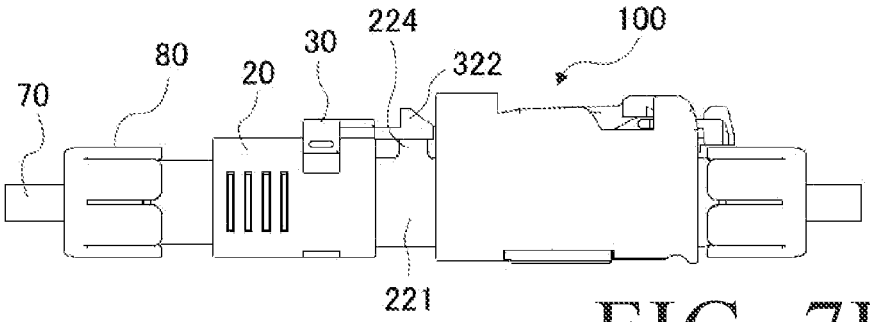
FIG. 7B is a side view of FIG. 7A.
Figure 7C:
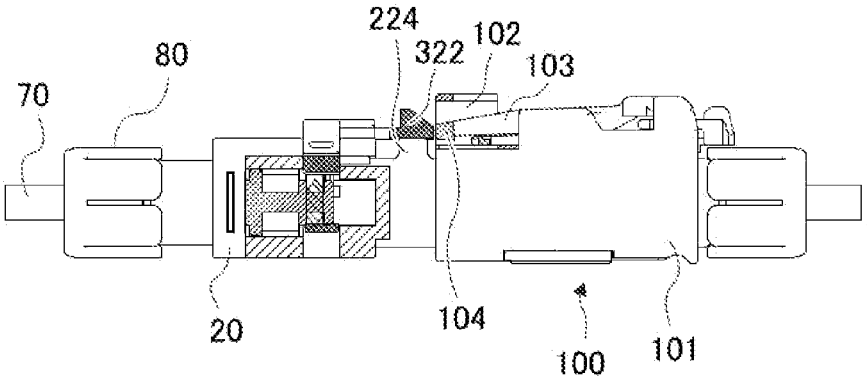
FIG. 7C is a partial cross-sectional view of the main part of FIG. 7B as taken away and viewed from a side.

In this state, as illustrated in FIGS. 7A to 7C, it is attempted to fit the coaxial cable connector 10 to the mating connector 100. Then, as best illustrated in FIG. 7C, the second lock protrusion 322 located above the first lock protrusion 224 abuts on the engagement frame 104 at the tip portion of the engagement arm 103 protruding toward the rear side in the fitting direction in the engagement opening 102 of the mating housing 101 of the mating connector 100. As a result, when the coaxial cable 70 is at the irregular insertion position, the coaxial cable connector 10 cannot be fitted to the mating connector 100.

Figure 8A:
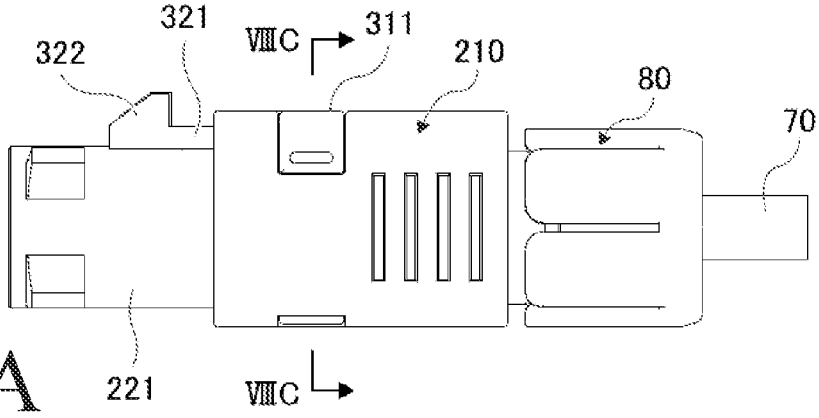
FIG. 8A is a side view when the coaxial cable connector is assembled and the coaxial cable is at the regular insertion position.
Figure 8B:
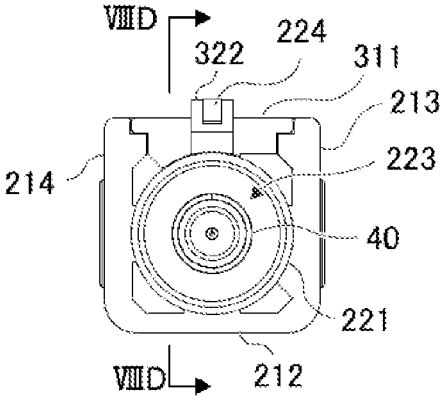
FIG. 8B is a front view when the coaxial cable connector in the state of FIG. 8A is viewed from the fitting side.
Figure 8C:
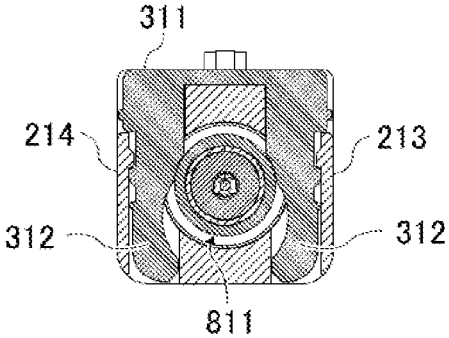
FIG. 8C is a cross-sectional view when the coaxial cable connector in the state of FIG. 8A is taken along line VIIIC-VIIIC and viewed from a side opposite to the fitting side.
Figure 8D:
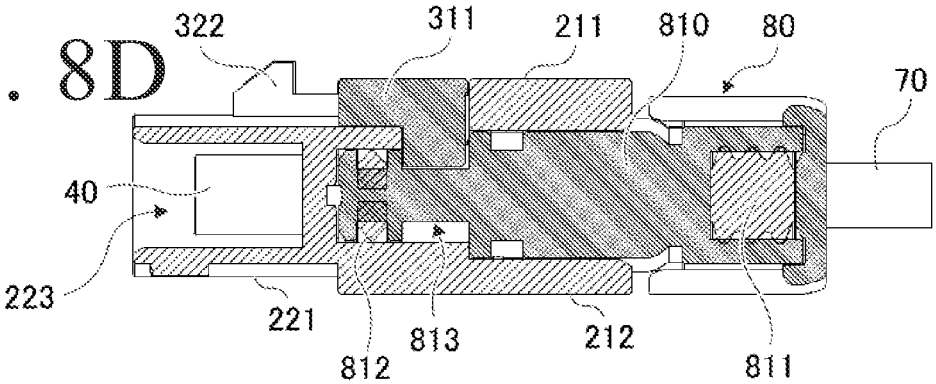
FIG. 8D is a cross-sectional view when the coaxial cable connector in the state of FIG. 8A is taken along line VIIID-VIIID in FIG. 8B and viewed from a side.

FIGS. 8A to 8D illustrate a state in which the coaxial cable 70 is inserted into the cable accommodation opening 216 of the coaxial cable connector 10 up to the regular insertion position. At this time, the alignment slot 813 of the core housing 80 mounted to the coaxial cable 70 reaches immediately below the retainer accommodation opening 217 of the housing body 210. When the retainer 30 is mounted to the housing 20 in this state, the two leg portions 312 of the retainer 30 are accommodated from the retainer accommodation opening 217 to the depth of the cable accommodation opening 216. At this time, as illustrated in FIGS. 8C and 8D, the leg portion 312 is inserted into the alignment slot 813 of the core housing 80.

As a result, the upper plate portion 311 of the retainer body 310 of the retainer 30 is flush with the upper surface of the housing body 210. The first lock protrusion accommodation opening 323 of the second lock protrusion 322 of the retainer 30 completely accommodates the first lock protrusion 224. At this time, the upper surfaces of the first lock protrusion 224 and the second lock protrusion 322 are aligned with each other at the same height in the radial direction, that is, aligned flush with each other, and as a whole, one lock protrusion protruding from the surface of the cylindrical portion 221 of the fitting protrusion 220 is formed. That is, the second lock protrusion 322 of the retainer 30 is positioned so as to be placed on the outer circumferential surface of the fitting protrusion 220 of the housing 20, and is movable to a position where the second lock protrusion 322 can be fitted to the mating connector as described later.

Figure 9A:
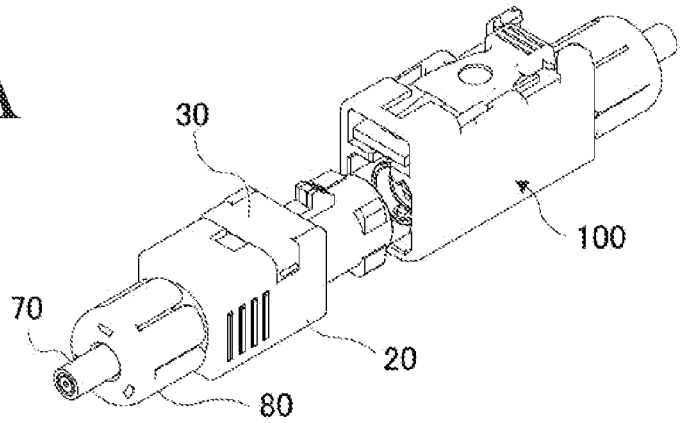
FIG. 9A is an external perspective view of a case where the coaxial cable connector is fitted to the mating connector in a state where the coaxial cable is at the regular insertion position.
Figure 9B:
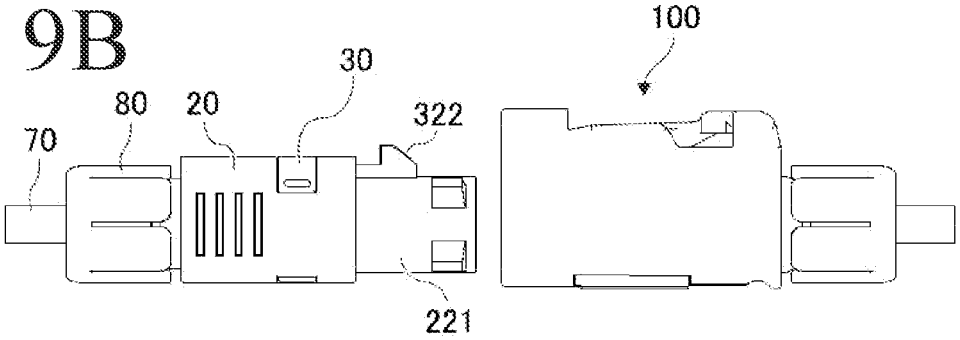
FIG. 9B is a side view of FIG. 9A.
Figure 9C:
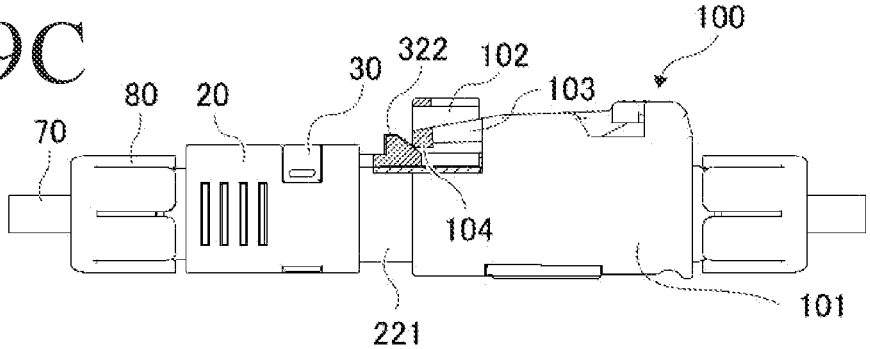
FIG. 9C is a partial cross-sectional view in a state where the fitting operation is further advanced with respect to the mating connector from the state of FIG. 9B and when the main part is taken and viewed from a side.

In this state, as illustrated in FIGS. 9A to 9C, it is attempted to fit the coaxial cable connector 10 to the mating connector 100. Then, as best illustrated in FIG. 9C, the first lock protrusion 224 and the second lock protrusion 322 are inserted into the engagement opening 102 of the mating housing 101 of the mating connector 100 below the engagement frame 104 at the tip portion of the engagement arm 103 protruding toward the rear side in the fitting direction. The first lock protrusion 224 and the second lock protrusion 322 have an inclined surface inclined so as to rise from the front in the fitting direction toward the rear in the fitting direction, and the inclined surface moves to the front in the fitting direction while being in contact with the engagement frame 104, thereby displacing the engagement arm 103 upward.

Figure 9D:
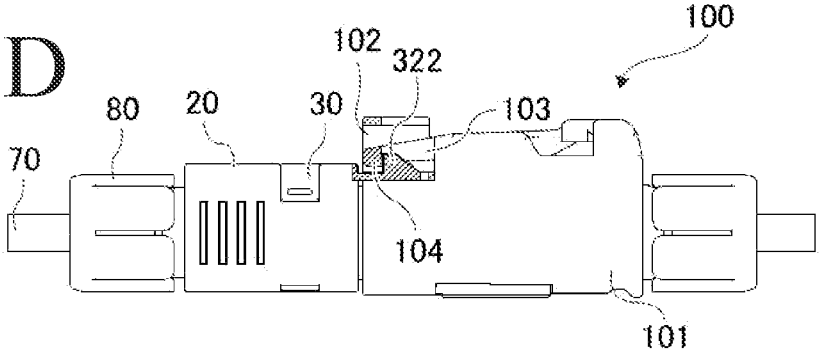
FIG. 9D is a partial cross-sectional view when the main part of the coaxial cable connector and the mating connector in the completely fitted state is taken and viewed from a side.

Next, the coaxial cable connector 10 is further moved forward in the fitting direction to be fitted to the mating connector 100. Then, as illustrated in FIG. 9D, the engagement frame 104 of the mating connector 100 is locked over the first lock protrusion 224 and the second lock protrusion 322, and a complete engagement state is obtained.

The configuration of the coaxial cable connector 10 and the operation at the time of fitting to the mating connector 100 have been described above. The coaxial cable connector 10 of the present embodiment has a male-type connector structure, and the mating connector 100 has a female-type connector structure. However, the functions of the male and the female may be replaced.

In the embodiment described above, an example in which the first lock protrusion 224 and the second lock protrusion 322 cooperate with each other as the lock protrusion has been described. However, the present invention is not limited to the above embodiment, and it is also possible to adopt a configuration in which the lock protrusion is provided only in the retainer 30 and the lock protrusion is not formed in the fitting protrusion 220 of the housing 20.

In the above embodiment, the configuration of the coaxial cable connector for connecting the coaxial cable to the mating connector 100 has been described as a cable, but the present invention is not limited to the above example, and can also be applied to a cable connector for connecting a normal cable to the mating connector 100.

With the above configuration, it is possible to provide a coaxial cable connector that is compatible with the FAKRA standard and has a small size and waterproof performance. The retainer 30 may be distributed in the market in a state of being mounted to the housing 20 in advance, or may be distributed separately from the housing 20.

What is claimed is:

1. A cable connector, comprising:

a housing including a cylindrical fitting protrusion to be inserted into a fitting opening of a mating connector; and a retainer that enables insertion of the fitting protrusion of the housing into the mating connector only when a cable accommodated in the housing is at a regular insertion position, wherein the retainer includes a lock protrusion that is at a position where fitting with the mating connector is prevented when a cable accommodated in the housing is at an irregular insertion position, and is movable to a position where fitting with the mating connector is enabled when the cable is at the regular insertion position, wherein the fitting protrusion includes a first lock protrusion protruding in a radial direction, and wherein the lock protrusion of the retainer is at a position shifted radially outward from the first lock protrusion as a second lock protrusion when the cable accommodated in the housing is at the irregular insertion position.

2. The cable connector according to claim 1, wherein the second lock protrusion of the retainer is aligned with the first lock protrusion at a same height in the radial direction when the cable is at the regular insertion position.

3. The cable connector according to claim 1, wherein the second lock protrusion of the retainer includes an opening that receives the first lock protrusion when the second lock protrusion is aligned with the first lock protrusion at the same height in the radial direction.

4. The cable connector according to claim 1, wherein an opening is not formed on an outer circumferential surface of the cylindrical fitting protrusion.

5. A cable connector, comprising:

a housing including a cylindrical fitting protrusion to be inserted into a fitting opening of a mating connector; and a retainer that enables insertion of the fitting protrusion of the housing into the mating connector only when a cable accommodated in the housing is at a regular insertion position, wherein the retainer includes a lock protrusion that is at a position where fitting with the mating connector is prevented when a cable accommodated in the housing is at an irregular insertion position, and is movable to a position where fitting with the mating connector is enabled when the cable is at the regular insertion position, wherein the fitting protrusion includes a first lock protrusion protruding in a radial direction, and wherein the lock protrusion of the retainer is aligned with the first lock protrusion at a same height in the radial direction when the cable is at the regular insertion position.

6. The cable connector according to claim 5, wherein the lock protrusion of the retainer is at a position shifted radially outward from the first lock protrusion as a second lock protrusion when the cable accommodated in the housing is at the irregular insertion position.

7. The cable connector according to claim 6, wherein the second lock protrusion of the retainer includes an opening that receives the first lock protrusion when the second lock protrusion is aligned with the first lock protrusion at the same height in the radial direction.

8. The cable connector according to claim 5, wherein an opening is not formed on an outer circumferential surface of the cylindrical fitting protrusion.

* * * * *